US009731732B2

(12) United States Patent
Golden et al.

(10) Patent No.: US 9,731,732 B2
(45) Date of Patent: Aug. 15, 2017

(54) SYSTEMS AND METHODS FOR VEHICLE CONTROL

(71) Applicant: General Electric Company, Schenectady, NY (US)

(72) Inventors: Samuel William Golden, Melbourne, FL (US); Kevin Kapp, Melbourne, FL (US)

(73) Assignee: General Electric Company, Schenectady, NY (US)

( * ) Notice: Subject to any disclaimer, the term of this patent is extended or adjusted under 35 U.S.C. 154(b) by 151 days.

(21) Appl. No.: 14/201,871

(22) Filed: Mar. 9, 2014

(65) Prior Publication Data

US 2015/0251676 A1 Sep. 10, 2015

(51) Int. Cl.
*B61L 15/00* (2006.01)
*B61L 27/00* (2006.01)

(52) U.S. Cl.
CPC ..... *B61L 15/0027* (2013.01); *B61L 27/0022* (2013.01); *B61L 27/0038* (2013.01); *B61L 27/0077* (2013.01)

(58) Field of Classification Search
CPC .. B61L 27/00; B61L 15/0027; B61L 27/0038; B61L 27/0022; B61L 27/0077
See application file for complete search history.

(56) References Cited

U.S. PATENT DOCUMENTS 7,206,676 B2 4/2007 Cross et al.
7,302,895 B2 12/2007 Kumar et al.
7,618,011 B2 11/2009 Oleski et al.
8,150,780 B2 4/2012 Brandt et al.
8,682,513 B2 * 3/2014 Chen ..... B61L 3/006 701/19
2005/0120904 A1 6/2005 Kumar et al.
2005/0143874 A1 6/2005 Peltz et al.
2008/0087772 A1 4/2008 Smith
2009/0292411 A1 11/2009 Smith et al.
2009/0299555 A1 12/2009 Houpt et al.
(Continued)

FOREIGN PATENT DOCUMENTS

AU 2009251095 A1 7/2010
EP 1552997 A2 7/2005

*Primary Examiner* — Mussa A Shaawat
*Assistant Examiner* — Michael Kerrigan
(74) *Attorney, Agent, or Firm* — Global Patent Operation; John A. Kramer

(57) ABSTRACT

A system configured to be disposed onboard a vehicle includes a communication unit and a processing unit. The communication unit is configured to obtain first trip information including first location-based operational information. The first trip information includes commands for a positive train control (PTC) system. The communication unit is also configured to obtain second trip information including second location-based operational information. The second trip information includes trip profile information for performing a mission by the vehicle. The processing unit is configured to obtain the first trip information and the second trip information from the communication unit, and to determine combined trip information using the first trip information and the second trip information. The processing unit is also configured to develop control information using the combined trip information.

24 Claims, 4 Drawing Sheets

(56) References Cited

U.S. PATENT DOCUMENTS

| | | | | |
|---|---|---|---|---|
| 2010/0057353 | A1* | 3/2010 | Friedman | G01C 21/3407 701/533 |
| 2010/0070116 | A1 | 3/2010 | Kumar et al. | |
| 2010/0131127 | A1 | 5/2010 | DeSanzo | |
| 2010/0168942 | A1 | 7/2010 | Noffsinger et al. | |
| 2010/0174484 | A1 | 7/2010 | Sivasubramaniam et al. | |
| 2011/0118914 | A1 | 5/2011 | Brooks et al. | |
| 2011/0186692 | A1 | 8/2011 | Kumar et al. | |
| 2012/0078454 | A1 | 3/2012 | Kumar | |
| 2012/0089537 | A1 | 4/2012 | Cooper et al. | |
| 2012/0126065 | A1* | 5/2012 | Smith | B61L 3/006 246/167 R |
| 2012/0136515 | A1 | 5/2012 | Noffsinger et al. | |

* cited by examiner

SYSTEMS AND METHODS FOR VEHICLE CONTROL

BACKGROUND

Positive or automatic control systems may be employed in transportation networks. As one example, a Positive Train Control (PTC) system may be understood as a system for monitoring and controlling the movement of a rail vehicle such as a train to provide increased safety. A train, for example, may receive information about where the train is allowed to safely travel, with onboard equipment configured to apply the information to control the train or enforce control activities in accordance with the information. For example, a PTC system may force a train to slow or stop based on the condition of a signal, switch, crossing, or the like that the train is approaching. As part of operating a PTC system, vehicles that will traverse a route covered by the PTC system may be provided with information describing location-based operational restrictions, such as speed limits, ranges where automatic or autonomous control is prohibited (e.g., manual control is required in such ranges), or the like. The operational restrictions may be based on beginning and ending points defined by locations along the route (e.g., mileposts).

However, the information provided via the PTC systems may be standardized for all vehicles traversing a route or network, and not be optimal for a particular vehicle traversing the route. For example, the information provided via the PTC system may have restrictions generally applicable to vehicles traversing the route, but a particular vehicle or vehicles may have additional restrictions appropriate based on the makeup or capability of the particular vehicle or vehicles. Further, PTC systems may not provide information corresponding to each feature of a vehicle. For example, a vehicle may have location based operational characteristics or functionalities that are not addressed or covered by standard information provided.

BRIEF DESCRIPTION

In an embodiment, a system includes a communication unit and a processing unit. The system is configured to be disposed onboard a vehicle configured to traverse a route. As used herein, the terms "system," "module," or "unit" include a hardware and/or software system that operates to perform one or more functions. For example, a module, system, or unit may include a computer processor, controller, or other logic-based device that performs operations based on instructions stored on a tangible and non-transitory computer readable storage medium, such as a computer memory. Alternatively, a module, system, or unit may include a hard-wired device that performs operations based on hard-wired logic of the device. The modules or units shown in the attached figures may represent the hardware that operates based on software or hardwired instructions, the software that directs hardware to perform the operations, or a combination thereof. The hardware may include electronic circuits that include and/or are connected to one or more logic-based devices, such as microprocessors, processors, controllers, or the like. These devices may be off-the-shelf devices that are appropriately programmed or instructed to perform operations described herein from the instructions described above. Additionally or alternatively, one or more of these devices may be hard-wired with logic circuits to perform these operations.

The communication unit is configured to obtain first trip information including first location-based operational information. (It may be noted that, as used herein, "to obtain" information may include receiving information transmitted from a source in various embodiments.) The first trip information includes commands for a positive train control (PTC) system. The communication unit is also configured to obtain second trip information that includes second location-based operational information. The second trip information includes trip profile information for performing a mission by the vehicle. The processing unit is configured to determine combined trip information using the first trip information and the second trip information received from the communication unit. The processing unit is also configured to develop control information using the combined trip information.

In an embodiment, a system includes a determination unit and a communication unit. The determination unit is configured to develop first location-based operational information for a vehicle traversing a route. The first location-based operational information developed by the determination unit differs from second location-based operational information provided from a different source. The first location-based information developed by the determination unit includes first range information that includes one or more ranges for modes of operation of the vehicle that differs from second range information from the different source. The second location-based operational information from the different source includes commands for a PTC system, and the first location-based operational information developed by the determination unit includes trip profile information for performing a mission by the vehicle. The communication unit is configured to transmit the trip information to the vehicle.

In an embodiment, a method includes obtaining, on-board a vehicle traversing a route, first trip information. In some embodiments, the first trip information may be obtained from a first source (e.g., an owner, operator, or administrator of the route). The first trip information includes first location-based operational information. The first trip information includes commands for a PTC system. The method also includes obtaining, on-board the vehicle, second trip information. The second trip information may, for example, be obtained from a second source (e.g., an owner, operator, or administrator of the vehicle). The second trip information includes second location-based operational information. The second trip information includes trip profile information for performing a mission by the vehicle. Also, the method includes determining, with a processing unit disposed onboard the vehicle, combined trip information using the first trip information and the second trip information. Further, the method includes developing control information using the combined trip information.

BRIEF DESCRIPTION OF THE DRAWINGS

The present inventive subject matter will be better understood from reading the following description of non-limiting embodiments, with reference to the attached drawings, wherein below.

DETAILED DESCRIPTION

Figure 1:
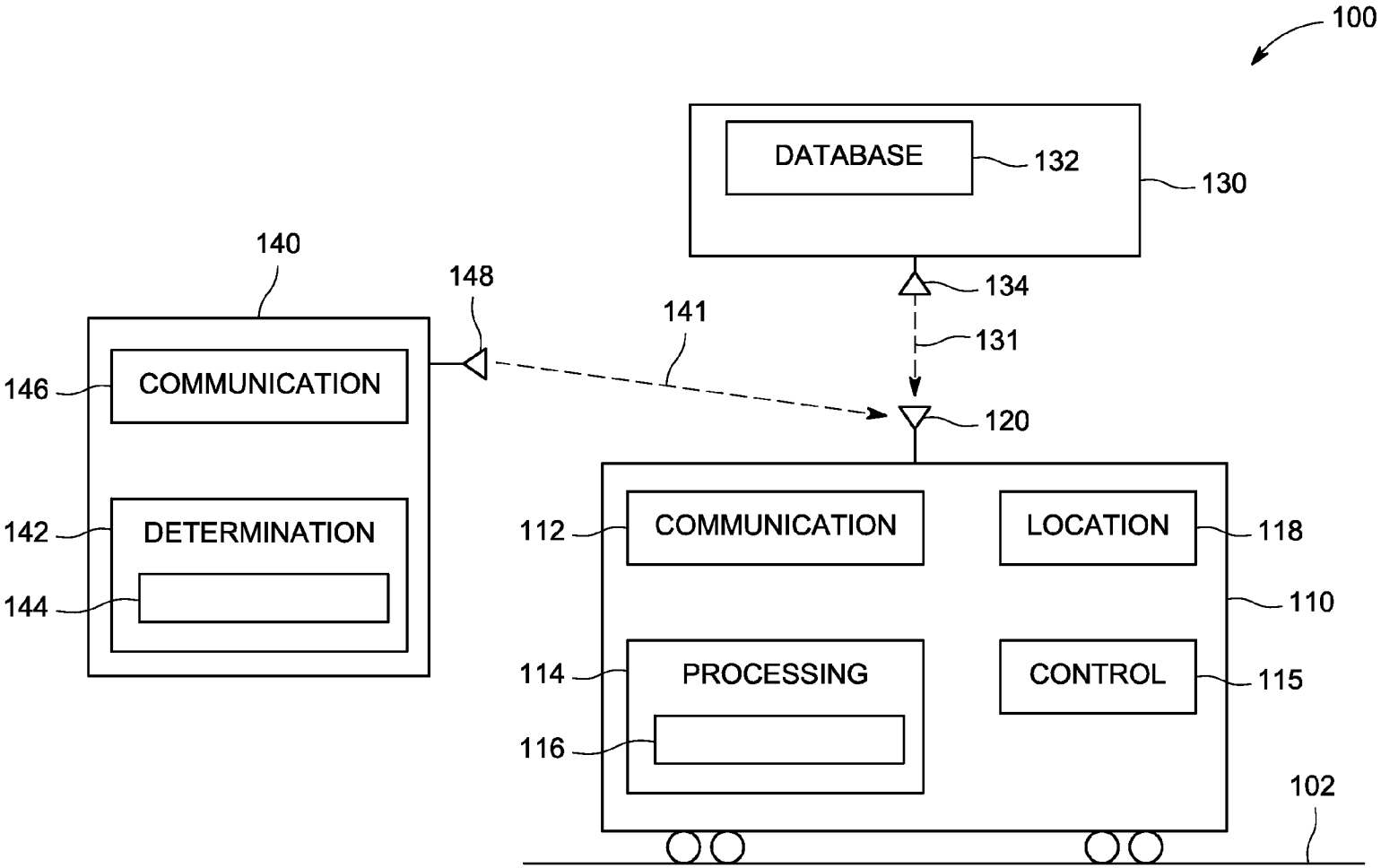
FIG. 1 is a schematic view of a transportation system in accordance with an embodiment.

One or more embodiments of the inventive subject matter described herein provide systems and methods for improved control, communication, and/or implementation of location-based operating features for a vehicle. In various embodiments, a vehicle may use combined information using trip information from more than one source, for example, to resolve conflicts between different sources, and/or to provide additional functionality, and/or to provide information tailored or customized for a particular vehicle in addition to information configured for or based upon a route over which the vehicle will travel.

For example, parameters (such as parameters that may be used by an energy management system of a vehicle) may be provided from a positive train control (PTC) system database to enable and/or disable features on a milepost (or other location) basis. For a given feature, a Start Milepost and End Milepost may be entered through an off-board system with the functionality that is to be enabled and/or disabled. A message containing the information for enabling and/or disabling may be sent to the vehicle (e.g., a processing unit onboard the vehicle) and stored in a configuration (e.g., a configuration for a particular subdivision). However, an additional message that overrides and/or supplements the information from the PTC system may be sent to the vehicle (e.g., from another source), allowing for the vehicle to combine that additional message with the message from the PTC system to develop control information better tailored for the individual vehicle. Thus, information from a system operated by an operator of the vehicle may be combined with information from a system operated by an operator of the route (e.g., a PTC system). The combined information may provide for additional safety and/or additional functionality. The information provided from various sources may be saved onboard and implemented or used as part of the next trip initialization sequence performed. (Trip initialization and trip initialization sequence refer to initially generating a trip plan or trip profile for a vehicle, as further explained below, typically before a trip of the vehicle commences, such as when the vehicle is stationary at a station or other location of embarkation.) Thus, an owner, administrator, or operator of a vehicle may achieve improved control of areas not approved or specified for at a milepost level by a PTC database, and/or control functionality not addressed by a PTC database. The improved control may be achieved remotely without making modification to information (e.g., a subdivision file) provided by an owner or operator of the route.

A technical effect of embodiments includes improved control over areas not addressed by a first information system (e.g., a system providing information from a PTC database) or first information type. A technical effect of embodiments includes providing remote implementation of additional functionality not addressed by a first information system (e.g., a system providing information from a PTC database) or first information type. A technical effect of embodiments includes providing additional safety control based on specific considerations of a vehicle or preferences of an owner, operator, or administrator of the vehicle.

The term "vehicle consist" may be used herein. A vehicle consist is a group of any number of vehicles that are mechanically coupled to travel together along a route. A vehicle consist may have one or more propulsion-generating units (e.g., vehicles capable of generating propulsive force, which also are referred to as propulsion units) in succession and connected together so as to provide motoring and/or braking capability for the vehicle consist. The propulsion units may be connected together with no other vehicles or cars between the propulsion units. One example of a vehicle consist is a locomotive consist that includes locomotives as the propulsion units. Other vehicles may be used instead of or in addition to locomotives to form the vehicle consist. A vehicle consist may also include non-propulsion generating units, such as where two or more propulsion units are connected with each other by a non-propulsion unit, such as a rail car, passenger car, or other vehicle that cannot generate propulsive force to propel the vehicle consist. A larger vehicle consist, such as a train, may have sub-consists. Specifically, there may be a lead consist (of propulsion or non-powered control units), and one or more remote consists (of propulsion or non-powered control units), such as midway in a line of cars and another remote consist at the end of the train. The vehicle consist may have a lead propulsion unit and a trail or remote propulsion unit. The terms "lead," "trail," and "remote" are used to indicate which of the propulsion units control operations of other propulsion units, and which propulsion units are controlled by other propulsion units, regardless of locations within the vehicle consist. For example, a lead propulsion unit may control the operations of the trail or remote propulsion units, even though the lead propulsion unit may or may not be disposed at a front or leading end of the vehicle consist along a direction of travel. A vehicle consist may be configured for distributed power operation, wherein throttle and braking commands are relayed from the lead propulsion unit to the remote propulsion units by a radio link or physical cable. Toward this end, the term vehicle consist should be not be considered a limiting factor when discussing multiple propulsion units within the same vehicle consist.

"Software" or "computer program" as used herein includes, but is not limited to, one or more computer readable and/or executable instructions that cause a computer or other electronic device to perform functions, actions, and/or behave in a desired manner. The instructions may be embodied in various forms such as routines, algorithms, modules or programs including separate applications or code from dynamically linked libraries. Software may also be implemented in various forms such as a stand-alone program, a function call, a servlet, an applet, an application, instructions stored in a memory, part of an operating system or other type of executable instructions. "Computer" or "processing element" or "computer device" as used herein includes, but is not limited to, any programmed or programmable electronic device that can store, retrieve, and process data. "Non-transitory computer-readable media" include, but are not limited to, a CD-ROM, a removable flash memory card, a hard disk drive, a magnetic tape, and a floppy disk. "Computer memory", as used herein, refers to a storage device configured to store digital data or information which can be retrieved by a computer or processing element. "Controller," "unit," and/or "module," as used herein, may refer to the logic circuitry and/or processing elements and associated software or program involved in controlling an energy storage system. The terms "signal", "data", and "information" may be used interchangeably herein and may refer to digital or analog forms.

FIG. 1 depicts a schematic view of a transportation system 100 in accordance with an embodiment. The transportation system 100 includes a vehicle 110 that traverses a route 102. The vehicle 110 is operably coupled with a first information system 130 and a second information system 140. The vehicle 110 may be configured as a vehicle consist, for example as a rail vehicle consist including one or more locomotives or other powered units, and one or more non-powered units. In various embodiments, the vehicle 110 obtains information from both the first information system 130 and the second information system 140, and utilizes information from each of the first information system 130 and the second information system 140 to control the movement of the vehicle 110. For example, the vehicle 110 may obtain location-based operational information from each of the first information system 130 and the second information system 140 (e.g., first location-based operational information and second location-based operational information, respectively) and combine the obtained information (e.g., at trip initialization) to control the movement of the vehicle 110. As used herein, location-based operational information may be understood as information describing, depicting, or otherwise corresponding to one or more geographical ranges over which one or more control or operational parameters are to be used or activities are to be performed. ("Range" refers to a specified geographic area, such as a specified section of a route.) For example, location-based operational information may define one or more manual ranges where only manual control of the vehicle 110 is permitted, and one or more automatic ranges where automatic or autonomous operation (e.g., operation without interference or involvement of a human operator) may be permitted in addition to manual control. (It may be noted that as used herein, "manual control" does not necessarily preclude all aspects of automation. For example, a vehicle being operated under manual control may be automatically controlled based upon a received signal from a PTC system that over-rides a manual input, such as a command to slow or stop due to occupancy of a portion of a route by a different vehicle.) Location-based operational information, as another example, may include information regarding ranges where a PTC system may be utilized and/or ranges not covered by a PTC system. As one more example, location-based operational information may include operational limits, such as speed limits, based on route configuration and/or vehicle configuration. As yet one more example, location-based operational information may include information corresponding to one or more ranges (or permitted values within a number of ranges) for use with an operational feature, such as tractive effort limitation. The ranges associated with location-based operational information may be identified based on mileposts of the route 102. As used herein, a "milepost" may be understood as a specific location identified along the length of a track or other route. A "milepost" need not necessarily correspond to a particular distance such as miles or a particular measurement system or standard.

Thus, the first information system 130 and the second information system 140 are sources of location-based operational information that is obtained by and utilized by the vehicle 110 to control the movement of the vehicle 110 during a mission or a portion thereof performed by the vehicle 110 as the vehicle 110 traverses the route 102. In the illustrated embodiment, the first information system 130 and the second information system 140 are distinct physical entities located at different locations. In various embodiments, the first information system 130 and the second information system 140 may be owned, operated, and/or administered by the same entity, while in other embodiments the first information system 130 and the second information system 140 may be owned operated and/or administered by different entities (e.g., the first information system by a first entity and the second information system by a second entity). For example, in some embodiments, the first information system 130 may be owned, operated, and/or administered by an owner, operator, and/or administrator of the route 102, and the second information system 140 may be owned, operated, and/or administered by an owner, operator and/or administrator of the vehicle 110. In some embodiments, the vehicle 110 may obtain first information 131 from the first information system 130 that is provided to one or more additional vehicles, and is standardized based on the route 102, while the vehicle may also obtain second information 141 from the second information system 140 that is customized for the vehicle 110. For example, the first information system 130 may provide first information 131 to the vehicle 110 that includes commands for a PTC system (e.g., one or more standard ranges over which manual and/or automatic control are permitted), while the second information system 140 may provide second information 141 to the vehicle 110 that includes additional operational information, such as one or more of different ranges over which automatic and/or manual control are permitted, trip profile information to be used by the vehicle 110 in planning and/or performing a mission, or additional operational features not addressed by the first information from the first information system 130.

In some embodiments, the first information 131 and the second information 141 may be provided to the vehicle 110 directly from the same source (e.g., off-board source such as first information system 130 or second information system 140). As one example, in some embodiments, the second entity may provide the second information 141 to the first entity, with the first entity providing the second information 141 to the vehicle 110 via the first information system 130. For instance, the second information system 140 may provide the second information 141 to the first information system 130, with the first information system 130 in turn transmitting the second information 141 to the vehicle 110, providing an example of the second information 141 being provided from the second information system 140 indirectly to the vehicle 110. Thus, the second trip information 141 may be directed through a common off-board source (e.g., the first information system) as the first information 131.

Thus, the vehicle 110 may obtain information (e.g., location-based operational information) from two or more distinct sources, or two or more distinct entities. For example, one source (and/or entity) may provide standardized information available and/or provided to other vehicles traversing the route 102, while one or more additional sources (and/or entities) may provide information that is configured for, tailored for, or otherwise customized for the particular vehicle 110. By way of example, the first information system 130 may provide speed limit information that is provided to the vehicle 110 as well as one or more additional vehicles traversing the route 102, with the speed limit information provided by the first information system 130 based on the route 102 without individual consideration of the capabilities and/or configuration of any particular vehicle receiving the information. However, the second information provided by the second information system 140 may include speed limit information based on the particular configuration and/or capabilities of the vehicle 110. For example, the second information system 140 may have access to information describing both the configuration of the vehicle 110 as well as information describing the route 102, and determine speed limits specifically for the vehicle 110 based on both the route 102 and the vehicle 110.

As another example, the first information system 130 may provide first information describing ranges where manual control of a vehicle traversing the route is required and ranges where automatic control is permitted, based upon the route 102 and/or the preferences or requirements of the owner, operator, and/or administer of the route 102, without reference to particular aspects of a given vehicle traversing the route. The second information system 140 may provide different ranges for automatic and/or manual control based on particular capabilities of the vehicle 110 or particular preferences or requirements of the owner, operator, or administrator of the vehicle 110. For example, the second information system 140 may provide second information that is more restrictive than the first information from the first information system 130. As used herein, information is more restrictive than other information when the information places less freedom and/or additional constraints on the operation of a vehicle. For example, a first set of information may provide a first speed limit, while a more restrictive second set of information may provide a second speed limit that is lower than the first speed limit. As another example, a first set of information may provide a first range where a mode of operation, such as automatic control of the vehicle, is permitted, while a second, more restrictive set of information may provide a second range where the mode of operation is permitted that is smaller than the first range.

In some embodiments, the second trip information may include information corresponding to an additional operation feature not included in the first trip information. Alternatively or additionally, the first trip information may include information corresponding to an additional operational feature not included in the second trip information. An operational feature may include a setting or parameter for operating the vehicle 110. For example, the second trip information may include information corresponding to tractive effort limitation, and the first trip information may not. Alternatively or additionally, the second trip information may have a higher resolution or granularity than the first trip information. For example, the second trip information may use smaller increments to define ranges than the first trip information. Further, the second trip information may include information corresponding to ranges not included in the first trip information.

The depicted vehicle 110 includes a communication unit 112, a processing unit 114, a control module 115, and a location unit 118. Generally, in the illustrated embodiment, the communication unit 112 obtains information from different sources (e.g., the first information system 130 and the second information system 140), and provides the information unit to the processing unit 114. The processing unit 114 combines the information and develops control information, which is utilized by the control module 115 to control the movement of the vehicle 110. The location unit 118 is configured to provide location information to the vehicle 110 that may be used by the vehicle 110 to control the movement and/or operation of the vehicle 110. For example, the vehicle 110 (e.g., the processing unit 114 and/or the control module 115) may determine the location of the vehicle and the appropriate location-based control information to utilize based on information from the location unit 118.

As described herein, the depicted communication unit 112 is configured to receive information from two or more sources and provide the information to the processing unit 114. For example, the communication unit 112 may receive information in different formats or pursuant to different communication protocols from different sources, and convert or combine the information to a single format. In some embodiments, the communication unit 112 may obtain first information from the first information system 130 that is in a standardized format, and may obtain second information from the second information system 140 that is in a proprietary format or otherwise unique or specific to the owner, operator, and/or administrator of the vehicle 110. In the illustrated embodiment, the vehicle 110 includes an antenna 120 operably coupled to the communication system 112, with the antenna configured to receive signals from the first information system 130 and the second information system 140. It may be noted that the vehicle 110 in other embodiments may include one or more antennae dedicated to a particular source of information. For example, a first antenna may be configured to obtain signals from the first information system 130 while a second antenna may be configured to obtain signals from the second information system 140.

In the illustrated embodiment, the communication unit 112 is configured to obtain first trip information from a first off-board source (e.g., the first information system 130). The communication unit 112 may be configured to one or more of receive messages, transmit messages, pre-process information or data received in a message, format information or data to form a message, decode a message, decrypt or encrypt a message, compile information to form a message, extract information from a message, or the like. The first trip information includes first location-based operational information for operating the vehicle 110 as the vehicle performs a mission along the route 102 based on position of the vehicle 110 along the route. For example, the first trip information may define one or more ranges over which one or more modes of operation of the vehicle 110 (e.g., automatic mode, manual mode) are permitted, and/or speed limits over one or more ranges of the route 102. The first trip information may be obtained from the first information system 130 which is operated by an owner, operator, and/or administrator of the route 102. The first trip information may be provided pursuant to an industry and/or governmentally implemented safety standard.

The communication unit 112 is also configured to obtain second trip information from a second off-board source (e.g., the second information system) that is different from the first off-board source. The second trip information in the illustrated embodiment includes second location-based operational information that is customized, tailored, configured, or adapted for the vehicle 110. For example, the second trip information may include ranges for operational modes adapted for the particular vehicle 110 (e.g., including preferences and/or requirements of the owner, operator, and/or administrator of the vehicle 110), operating parameters for features not addressed by the first trip information, trip profile information or trip planning information for controlling the movement of the vehicle 110, or the like. The second trip information may be provided by an owner, operator, and/or administrator of the vehicle, and may be provided in a different format or pursuant to a different communication protocol than the first trip information.

The depicted processing unit 114 is disposed onboard the vehicle 110, and is configured to receive the first and second trip information from the communication unit 112. In various embodiments, the processing unit may, additionally or alternatively to the communication unit, translate or otherwise modify the first and second trip information to be in the same format and/or protocol. In the illustrated embodiment, the processing unit 114 includes a memory 116.

The depicted processing unit 114 is configured to obtain the first trip information and the second trip information from the communication unit 112 (which, in turn, has obtained the first trip information from the first information system 130 and the second trip information from the second information system 140), and to determine combined trip information using the first trip information and the second trip information. In some embodiments, the combined trip information may be determined by adding the first and second trip information together. In other embodiments, the first trip information and the second trip information may have inconsistencies therebetween that are addressed and/or resolved by the processing unit 114 as part of combining the first and second trip information. For example, when one or more aspects of the first and second trip information addressing a common feature or functionality (e.g., a range over which autonomous control is permitted) differ, the combined trip information may be determined by selecting the more restrictive aspects of the first and second trip information. For example, if the second trip information specifies a larger range where manual control is required or automatic control is prohibited than the first trip information, the combined information may be determined using the second trip information.

The processing unit 114 in the illustrated embodiment is also configured to develop control information using the combined trip information. For example, the processing unit 114 may develop command controls (e.g., specifying speed limits for one or more ranges and/or ranges within which manual and/or automatic control modes are to be employed), specify operating parameters (e.g., values for operational parameters such as tractive effort limitation for one or more ranges), and/or develop and/or implement a trip plan or trip profile. The control information may include information or commands for controlling the vehicle 110, including limits, modes of operation for given ranges, tractive commands such as propulsion and braking, or the like. The control information may provide information for use at specific locations along the route 102 during performance of a mission by the vehicle 110. The control information may include or be determined using a trip profile. In some embodiments, the second trip information (e.g., the trip information received from the second information system 140) may include a trip profile, or information from which the processing unit 110 may determine the trip profile on-board the vehicle 110. The trip profile may be determined using a system such as the Trip Optimizer™ system of the General Electric Company, or other energy management system. For additional discussion regarding a trip profile, see U.S. patent application Ser. No. 12/955,710, Publication No. 2012/0136515, "Communication System for a Rail Vehicle Consist and Method for Communicating with a Rail Vehicle Consist," filed 29 Nov. 2010, the entire content of which is incorporated herein by reference. In various embodiments, the control system 114 may provide the determined control information to a propulsion system and/or the control module 115 of the vehicle 110. For example, the second trip information may include trip profile information used by the processing unit 114 to develop a trip profile for use by an energy management system of the vehicle 110 (e.g., a control system using Trip Optimizer™ or other energy management systems). The processing unit 114 may develop a set of operational commands or instructions configured for use along the route 102 as the vehicle 110 performs a mission. The trip profile may be configured to improve or maximize efficiency of performance of the mission.

The first and second trip information may be combined to develop the control information as part of trip initialization. Additionally or alternatively, the control information and/or a trip profile may be modified during performance of a mission. For example, as a vehicle traverses from one route to another, the vehicle may receive additional information. For instance, when a vehicle leaves a route owned or operated by a first entity and enters a route owned or operated by a second entity, the second entity may provide trip information for the portion of the mission being performed along route owned or operated by the second entity. As another example, the objectives of a mission may change during performance of the mission, or a portion of route previously available may become unavailable (e.g., due to an accident).

In various embodiments, the first trip information and the second trip information include range information corresponding to geographic ranges for use of a first or second mode of operation of the vehicle. For example, the first trip information may include first milepost information defining one or more first zones where manual control of the vehicle is mandated (or autonomous control not permitted), and the second trip information may include second milepost information defining one or more second zones where manual control of the vehicle is mandated. The processing unit 114 may develop the combined trip information to include combined milepost information that includes the one or more first zones and the one or more second zones.

The control module 115 in the illustrated embodiment is configured to control operation of the vehicle 110. As one example, the control module 115 may operate, over at least a portion of a mission, in an autonomous mode to operate the vehicle 110 without operator input. For example, the control module 115 may autonomously implement control actions called for by a trip plan. One or more ranges during which the control module 115 operates in the autonomous mode may be determined by control information provided by the processing unit 114. The control module 115 may use location information from the location unit 118 or other source to determine control actions and/or modes based on location of the vehicle 110. Further, the control module 115 may be configured to override an operator input, a control action called for by a trip plan, or the like. For example, the control module 115 may increase the speed of the vehicle 110, decrease the speed of the vehicle 110, stop the vehicle 110, or start the vehicle 110 in motion responsive to a command or instruction from a PTC system (e.g., a PTC system associated with the first information system 130). The command or instruction from the PTC system may come, for example, from a wayside station passed or approached by the vehicle 110 as the vehicle 110 traverses the route 102. Thus, the control module 115 may be configured to perform, for example, control tasks that are performed autonomously without operator interference and/or are configured to override or ignore any inconsistent operator inputs. For example, in various embodiments, the control module 115 may be configured to receive PTC signals from wayside equipment and to control the vehicle 110 accordingly.

The location unit 118 in the illustrated embodiment is disposed onboard the vehicle 110 and is configured to determine the location of the vehicle 110 or provide information from which the location of the vehicle 110 may be determined. The location of the vehicle may be determined, for example, with reference to milepost markers along the route 102. The location unit 118 may include a GPS transceiver, and/or may receive location information from an additional or alternative source. For example, an operator may input a location at a point along the route 102 where the vehicle 110 is stopped, and a subsequent location of the vehicle 110 may be determined using a tachometer or, as another example, calculated based on the speed of the vehicle and the time since the stop. The location unit 118 is configured to provide information to the processing unit 114 and/or the control module 115, which use the information to identify where the vehicle 110 is located at a given time (e.g., at a particular milepost or within a range defined by mileposts) and to control the vehicle 110 as appropriate using location-based operational information based on the determined location.

The first information system 130 is configured to provide first trip information to the vehicle 110. In the illustrated embodiment, the first information system 130 includes a database 132 storing location-based operational information. The database 132 may be a PTC database. For example, the database 132 may identify, among other things, various ranges of the route 102 over which autonomous control is permitted and over which autonomous control is not permitted. The first trip information may be provided by the first information system 130 via the antenna 134. The first trip information may be standardized based on the route 102 without consideration for configurations or capabilities of individual vehicles, with the first trip information provided to plural vehicles traversing a route associated with the first information system. The first information system 130 may be operated and administered by a party that owns, operates, or administers the route 102.

The second information system 140 is configured to provide second trip information to the vehicle 110. In the illustrated embodiment, the second information system 140 is operated or administered by a party that owns, operates, or administers the vehicle 110, and the second trip information is tailored specifically for the vehicle 110. For example, the second trip information may include more restrictive information based on particular capabilities and/or limitations of the vehicle 110. Thus, for instance, the second trip information may specify one or more speed limits that are lower than called for by the first trip information. As another example, the second trip information may specify larger ranges over which autonomous control is not permitted. In various embodiments, the second information system 140 may be owned, operated, or administered by the same party that owns, operates, and administers the route 102, while in other embodiments the second information system 140 may be owned, operated, or administered by a different party.

In the illustrated embodiment, the second information system 140 includes a determination unit 142, a communication unit 146, and an antenna 148. The determination unit 142 includes a memory 144. The determination unit 142 is configured to develop location-based operational information for the vehicle 110 traversing the route 102. The location-based operational information determined by the determination unit 142 may differ from the information provided by a different source (e.g., the first information system 130). For example, the location-based operational information may be determined by the determination unit 142 with knowledge of or access to the configuration, capabilities, and/or limitations of the vehicle 110, and tailored for the vehicle 110 and/or a specific mission to be performed by the vehicle 110.

In some embodiments, the location-based information determined by the determination unit 142 may include range information corresponding to one or more ranges for modes of operation (e g, manual, autonomous) of the vehicle 110 differing from range information from the first information system 130. Additionally or alternatively, the location-based operational information determined by the determination unit 142 and provided to the vehicle 110 may include trip profile information configured for use by an energy management system of the vehicle 110. The trip profile information may include information from which a trip profile may be determined by the vehicle 110 (e.g., the processing unit 114 of the vehicle 110), or may include a trip profile that has already been determined for use or implementation by the vehicle 110. The location-based operational information may specify a range for which an autonomous mode of operation is permitted that differs from a range provided by the first information system 130. Further additionally or alternatively, the location-based operational information determined by the determination unit 142 may include information corresponding to an additional operational feature not included in information provided by the first information system 130. For example, the additional operational feature may include a tractive effort limitation parameter that varies over at least one range of the route 102. The determination unit 142 in various embodiments may determine the location-based operational information with or without knowledge of or access to the first trip information provided by the first information system 130.

The communication unit 146 of the illustrated second information system 140 is configured to transmit the trip information developed by the determination unit 142 (e.g., the second trip information) to the vehicle 110. For example, the communication unit 146 may be configured to transmit the trip information to the vehicle 110 using the antenna 148. The communication unit 146 may be configured to one or more of receive messages, transmit messages, pre-process information or data received in a message, format information or data to form a message, decode a message, decrypt or encrypt a message, compile information to form a message, extract information from a message, or the like. In various embodiments, the communication unit 146 may transmit the trip information in a format that may be received only be vehicles that are owned, operated, or administered by the party that owns, operates, or administers the second information system 140. In some embodiments, the communication unit 146 may be configured to receive the first trip information from the first information system 130, and the determination unit 142 may develop the second trip information with knowledge of or access to the first trip information.

It should be noted that FIG. 1 is schematic in nature and intended by way of example. In various embodiments, various aspects or modules or units may be omitted, modified, or added. Further, various units, modules, systems, or other aspects may be combined. Yet further still, various units, modules, or systems may be separated into sub-units or sub-systems and/or functionality of a given unit or system may be shared between or assigned differently to different units or systems.

Figure 2:
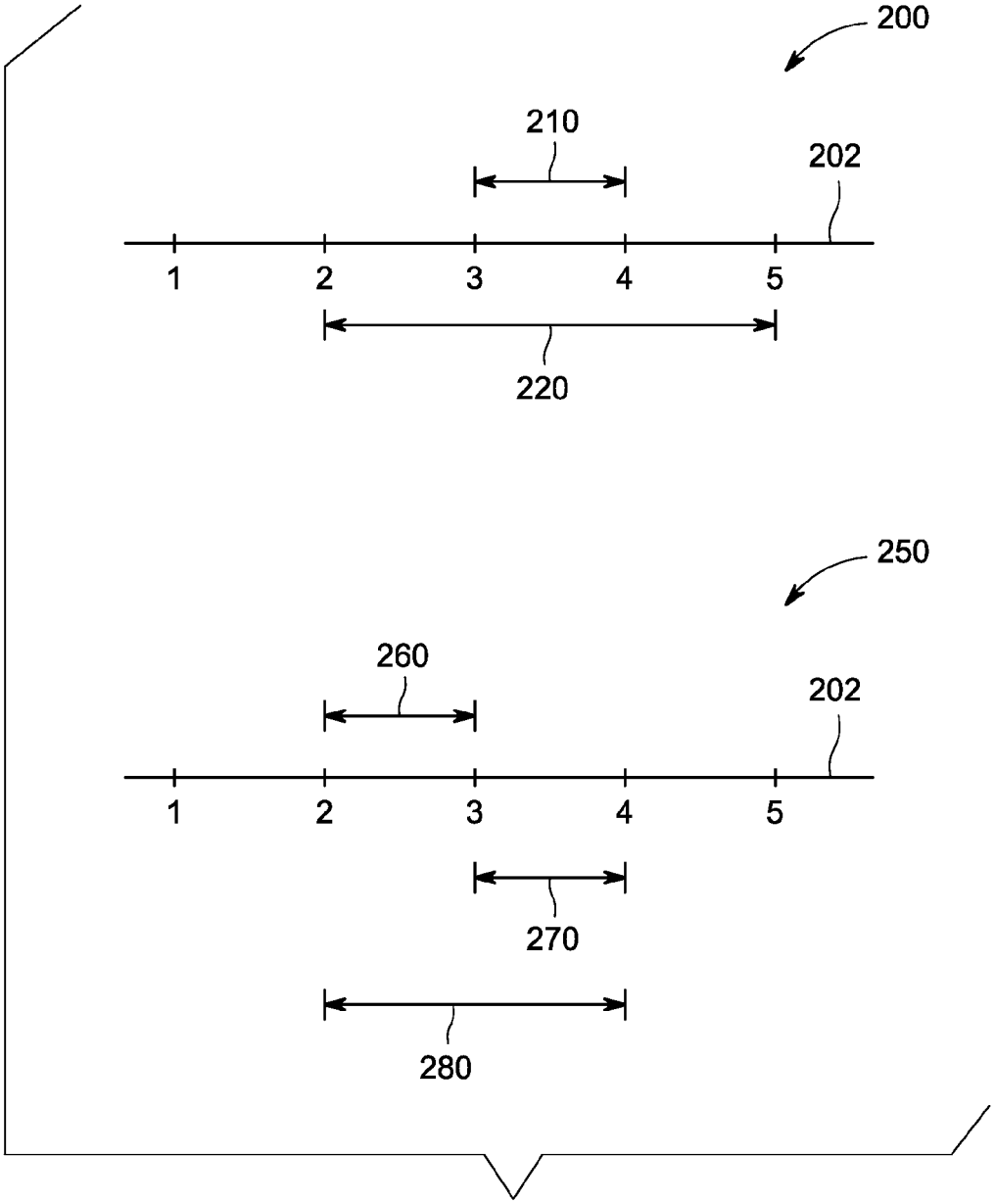
FIG. 2 illustrates example scenarios of determining combined information in accordance with an embodiment.

FIG. 2 provides examples of trip information provided by the various information systems and the combination of the trip information. For example, in a first example scenario 200, the first and second information systems provide information describing ranges over which autonomous control is not permitted. In the first scenario 200, the first information system (e.g., a system operated by an operator of a route) identifies a first range 210 that is disposed between Milepost 3 and Milepost 4 along a route 202. The second information system (e.g., a system operated by an operator of the vehicle) identifies a second range 220 that is disposed between Milepost 2 and Milepost 5. The second information system may determine that autonomous control, while permitted by the first information system between Mileposts 2 and 3 and between Mileposts 4 and 5, is not appropriate based on specific considerations of the vehicle. The determination unit 142 may develop the combined information to include all ranges from both the first and second trip information that prohibit autonomous control, such that the combined information used to control the vehicle specifies the second range 220 (which includes the first range 210) as the range over which autonomous control is not permitted.

As another example, in a second example scenario 250, the first and second information systems again provide information describing ranges over which autonomous control is not permitted. In the second scenario 250, the first information system (e.g., a system operated by an operator of a route) identifies a first range 260 that is disposed between Milepost 2 and Milepost 3 along the route 202. The second information system (e.g., a system operated by an operator of the vehicle) identifies a second range 270 that is disposed between Milepost 3 and Milepost 4. The vehicle 110 (e.g., the processing unit 142) may select the most restrictive setting over any given portion of the route 202 to identify ranges for which autonomous control is not permitted. Thus, the determination unit 142 may develop the combined information to include all ranges from both the first and second trip information that prohibit autonomous control, such that the combined information used to control the vehicle specifies the combined range 280 (which is disposed between Mileposts 2 and 4) includes the first range 260 and the second range 270) as the range over which autonomous control is not permitted.

Thus, the owner, operator, or administrator of the vehicle 110 may provide additional location-based information with which the vehicle 110 may use to control movement over the route 102 during the mission, with the vehicle 110 not limited to only the information provided by the information provided by the first information system 130. The vehicle 110 may enforce the more restrictive of the first or second trip information to comply with any safety restrictions. It should be noted that the above example scenarios are provided for illustrative purposes and be way of example and not limitation. In various embodiments, additional or alternative information may be included in the first and second trip information and/or combined. For example, other features and/or modes of operation may be enabled and/or disabled over one or more ranges based on the first and second trip information.

Figure 3:
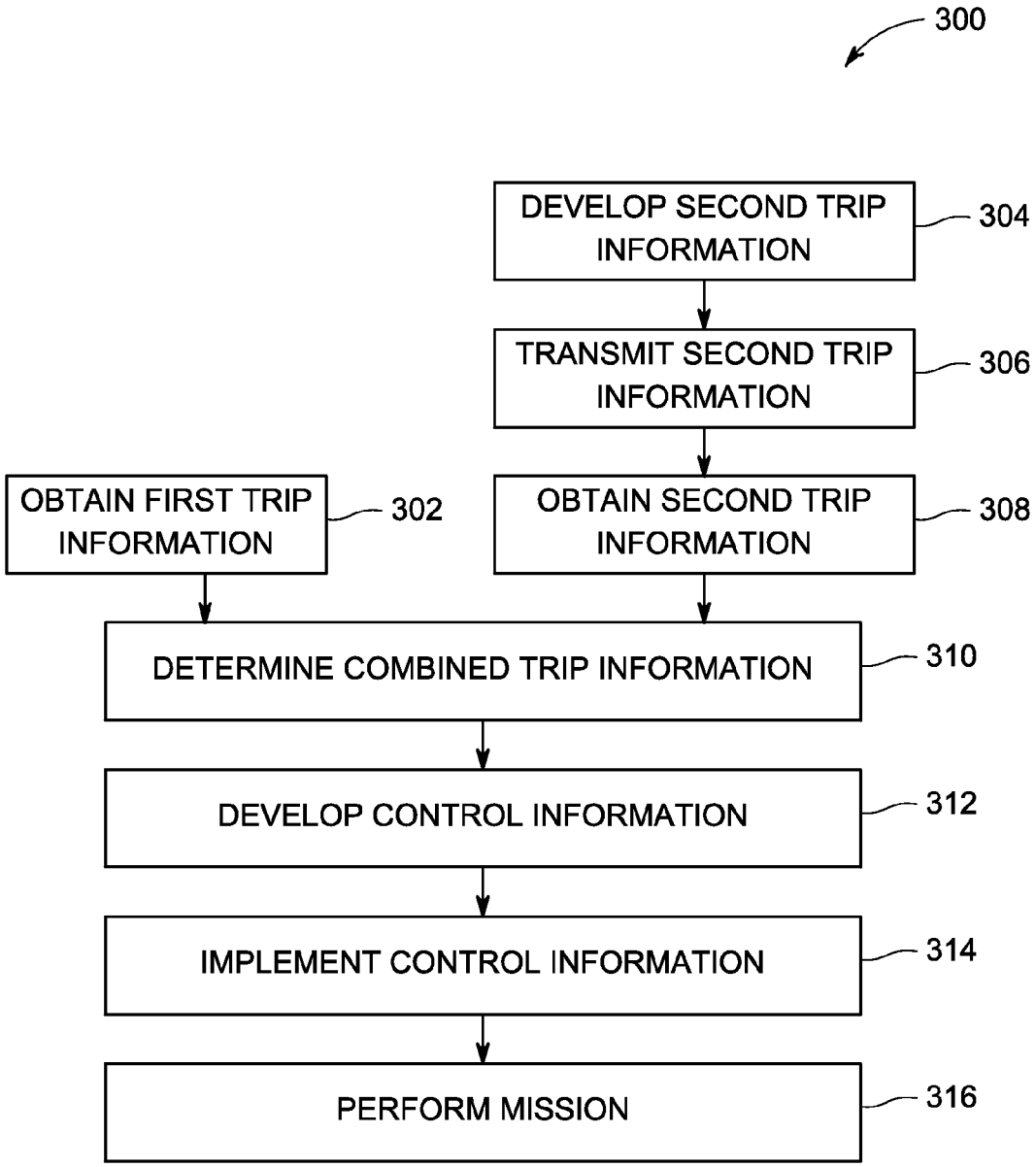
FIG. 3 is a flowchart of an embodiment for developing control information for a vehicle.

FIG. 3 is a flowchart of an embodiment of a method 300 for operating a vehicle, e.g., a rail vehicle. The method 300 may be performed, for example, using certain components, equipment, structures, or other aspects of embodiments discussed above. In certain embodiments, certain steps may be added or omitted, certain steps may be performed simultaneously or concurrently with other steps, certain steps may be performed in different order, and certain steps may be performed more than once, for example, in an iterative fashion.

At 302, first trip information is obtained. It may be noted that, as used herein, to obtain information may include to receive the information (e.g., to receive information transmitted from a source). The first trip information may be obtained via an antenna and communication unit disposed onboard the rail vehicle. The first trip information, for example, may include trip information from a PTC database that is provided to plural vehicles traversing a given route or portion of the route, irrespective of individual capabilities or limitations of the vehicles. The first trip information may be provided by a first information system operated by an owner, operator, or administer of a route (e.g., a railroad track) over which the vehicles traverse.

At 308, second trip information is obtained. The second trip information may be obtained via an antenna and communication unit disposed onboard the rail vehicle. The second trip information may include additional or supplemental information compared to the first trip information. The second trip information may be tailored for or addressed to the individual rail vehicle, and may be provided by the owner, operator, or administrator of the rail vehicle. For example, the second trip information may include more restrictive safety controls based on particular capabilities or limitations of the rail vehicle (e.g., size, length, type of cargo, braking capability, traction available from wheels, turning ability, or climbing ability, among others), or may include trip planning information corresponding to a mission to be performed by the particular rail vehicle.

For example, in some embodiments, the second trip information may have been developed at 304 by a determination unit (e.g., determination unit 142) of an information system (e.g., second information system 140) that is operated by the owner, operator, or administer of the particular rail vehicle. The second trip information may be transmitted from the second information system 140 to the rail vehicle at 306.

At 310, combined trip information is determined. The combined trip information may be determined using the first trip information and the second trip information. In various embodiments, for any given range or portion thereof, the combined trip information may be configured to enforce the most restrictive command or instruction provided by the first trip information or the second trip information. For example, if the second trip information specifies a lower speed limit or smaller range where autonomous operation is permitted, the combined trip information may include the lower speed limit or smaller range. The combined trip information may be determined, for example, by a processing unit disposed onboard the rail vehicle.

At 312, control information is developed using the combined trip information. For example, the control information may include commands or instructions to enforce safety restrictions of the combined trip information, to activate (or de-activate) operational features based on location (e.g., location within a range) of the rail vehicle, to implement a trip plan of the combined trip information, or the like. The control information may specify ranges for specific values of operational parameters and/or specify the enabling or disabling of one or more features or operational modes (e.g., manual mode, autonomous mode) based on location.

At 314, the control information is implemented. For example, the control information may be implemented as part of a trip initialization sequence and used to control the rail vehicle as the rail vehicle performs a mission at 316. During the mission, signals from a PTC system corresponding to track occupancy or other situations requiring deviation from a trip plan may be provided to the rail vehicle and used to control the rail vehicle accordingly. The trip plan and/or control information may be modified or updated during performance of the mission, for example if the vehicle receives additional information from an additional PTC system encountered during performance of the mission.

Figure 4:
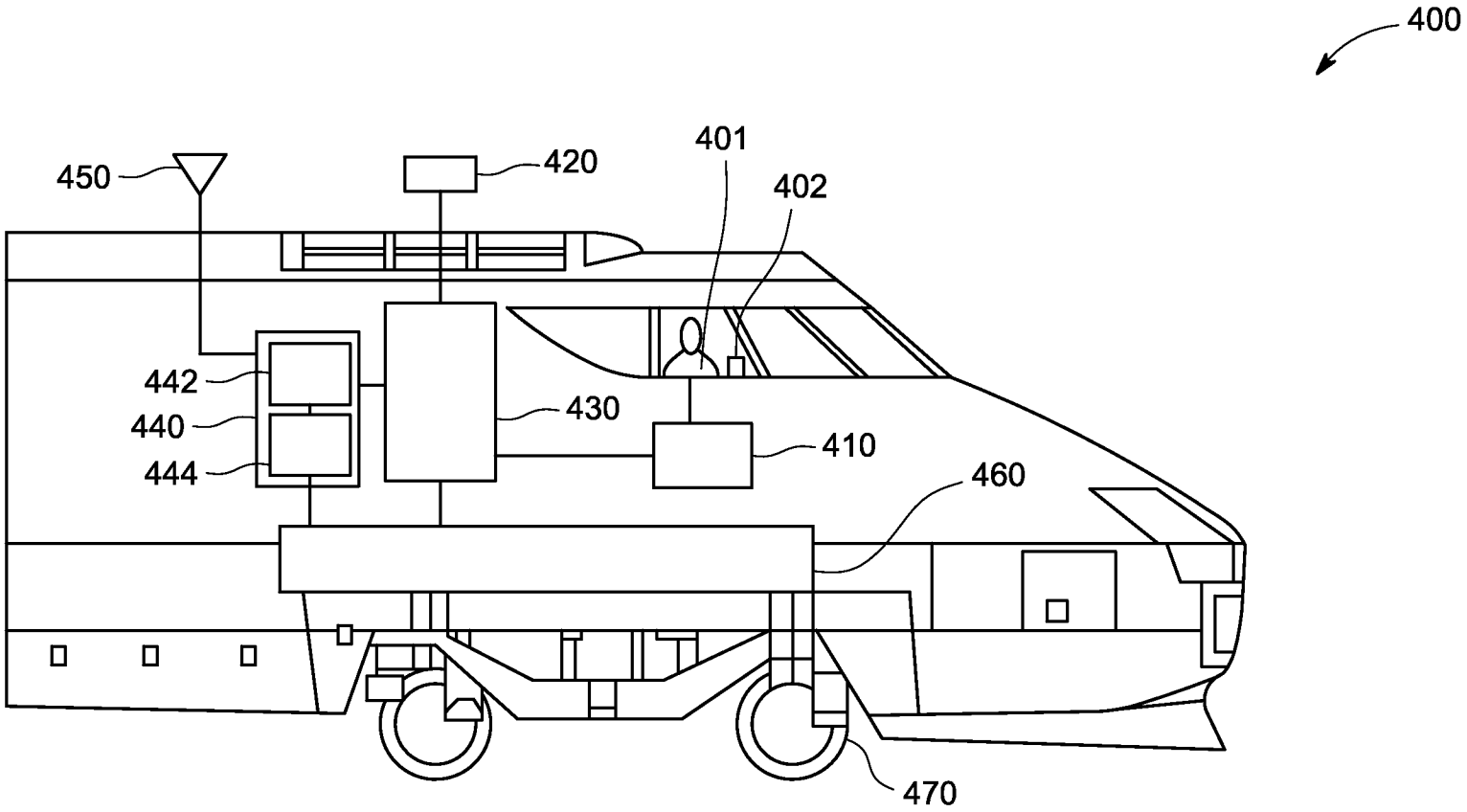
FIG. 4 is a schematic view of a vehicle system in accordance with an embodiment.

FIG. 4 provides a schematic view of a vehicle system 400 formed in accordance with an embodiment. The vehicle system 400 may include, for example, a rail vehicle consist including rail vehicle units (e.g., locomotives and non-powered units). The vehicle system 400 of the illustrated embodiment includes a display module 402, a manual input module 410, an automatic input module 420, an automatic control module 430, a trip planning control module 440, an antenna 450, a propulsion system 460, and wheels 470. Generally, in the depicted embodiment, the trip planning control module 440 is configured to plan a trip and to provide control messages, either to an operator and/or directly to the propulsion system 460, to propel the vehicle system 400 along a trip or mission. The trip planning control module 440 may include, or receive information or commands from, a processing unit such as the processing unit 114 described herein. The propulsion system 460 may include one or more motors and one or more brakes, with the control messages configured to cause the propulsion system to engage in braking or motoring activities in accordance with a trip plan. The automatic control system 430 may be configured to operate in accordance with a PTC system. In the illustrated embodiment, the automatic control system 430 is configured to override the trip planning control module 440 and/or an operator control, for example, to stop or slow the vehicle system 400 in accordance with a rule, for example a speed limit, or a safety condition such as a lockout or circumstance where another vehicle occupies a segment of a route the vehicle system 400 would otherwise enter pursuant to a command by the trip planning control module 440 and/or operator control. The antenna 450 is configured for communication between the vehicle system 400 and one or more off-board systems, such as, for example, wayside stations and/or central scheduling systems and/or other vehicles traversing a transportation network. The antenna 450, for example, may be configured to receive transmissions from the first information system 130 and the second information system 140 described herein. The rail vehicle system 400 is depicted as a single powered rail vehicle unit for ease of depiction. Other vehicle systems, including rail vehicle consists, may be employed in other embodiments.

The display module 402 is configured to provide information to an operator 401, and the manual input module 410 is configured to receive information from the operator 401. The display module 402 may include one or more of a screen, lights, speaker, bell, or the like configured to convey information to an operator. The display module 402 may provide an operator with prompts. The operator may control the vehicle over one or more ranges specified over which autonomous control is not permitted, while autonomous control may be employed over other ranges.

The manual input module 410 is configured to obtain manually input information including manually input location information. The manually input location information may be used alone or in conjunction with automatically input location information to determine the location of the rail vehicle system 400. The manually input information may correspond to information obtained via operator observation from one or more sources. For example, the manually input information may be obtained from a sign or other object configured to convey position information and mounted, hung, or otherwise disposed proximate to a track or route.

The automatic input module 420 is configured to automatically obtain (e.g., without operator intervention) location information and/or timing information. The automatically obtained information may correspond to a location along a track or route (e.g., information from a GPS detector giving a geographic position or identifying a segment of a track or route where the vehicle system 400 is located); and/or a direction (e.g. information from a GPS detector taken at different times with the vehicle system 400 in motion used to determine a trend or direction). The automatic input module 420 may include one or more of a GPS detector, an axle tachometer, inertial system, LORAN system, or the like. Further, the automatic input module 420 may include a receiver configured to receive location information from a transponder associated with a track or route on which the vehicle system 400 is disposed, for example a transponder associated with a wayside station, a switch, and/or a signal. For example, a message associated with a switch may provide information regarding a change from one track or route to another due to a position of the switch, or may include information corresponding to a vehicle's position along a route or track based on the location of the wayside station. The automatic detection module 420 in various embodiments thus may detect information corresponding to the position of the vehicle system 400 along the length of a given route and/or a particular sub-route on which the vehicle system 400 is traveling.

In the illustrated embodiment, the automatic control module 430 is configured to control the vehicle system 400 to conform to a set of regulations along a route during a trip or mission performed by the vehicle system 400. The automatic control module 430 may be configured to control the vehicle system 400 pursuant to a PTC system. The regulations may be location-based regulations. The regulations may be based on a rule or requirement of operation for a particular route segment, such as a speed limit or the like. The regulations may also correspond to a condition of a track or related componentry, such as if a route segment is occupied by a different vehicle, if a switch is misaligned, or the like. The automatic control module 430 may use location information provided by the manual input module 410 and/or the automatic input module 420 (e.g., location along the particular track) to determine appropriate automatic control activities. The automatic control module 430, when enabled, may override or interrupt a previously planned controlled activity (e.g., a control activity previously determined by the trip planning control module 440) and/or an operator controlled activity.

The trip planning control module 440 of the vehicle system 400 may be configured to receive a schedule sent by an off-board scheduling system, or to implement trip planning information sent by an off-board system (e.g., the second information system 140). The trip planning control module 440 may include a controller, such as a computer processor or other logic-based device that performs operations based on one or more sets of instructions (e.g., software). The instructions on which the controller operates may be stored on a tangible and non-transitory (e.g., not a transient signal) computer readable storage medium, such as a memory 444. The memory 444 may include one or more computer hard drives, flash drives, RAM, ROM, EEPROM, and the like. Alternatively, one or more of the sets of instructions that direct operations of the controller may be hard-wired into the logic of the controller, such as by being hard-wired logic formed in the hardware of the controller.

In the illustrated embodiment, the control module 442 receives the schedule sent from the scheduling system and generates a trip plan based on the schedule. The trip plan may include throttle settings, brake settings, designated speeds, or the like, of the vehicle system 400 for various sections of a scheduled trip or mission of the vehicle system 400 to the scheduled destination location.

In order to generate the trip plan for the vehicle system 400, the control module 442 can refer to a trip profile that includes information related to the vehicle system 400, information related to a route over which the vehicle system 400 travels to arrive at the scheduled destination, and/or other information related to travel of the vehicle system 400 to the scheduled destination location at the scheduled arrival time. The information related to the vehicle system 400 may include information regarding the fuel efficiency of the vehicle system 400 (e.g., how much fuel is consumed by the vehicle system 400 to traverse different sections of a route), the tractive power (e.g., horsepower) of the vehicle system 400, the weight or mass of the vehicle system 400 and/or cargo, the length and/or other size of the vehicle system 400, the location of powered units in the vehicle system 400, or other information. The information related to the route to be traversed by the vehicle system 400 can include the shape (e.g., curvature), incline, decline, and the like, of various sections of the route, the existence and/or location of known slow orders or damaged sections of the route, and the like.

The trip plan is formulated by the control module 442 based on the trip profile (e.g., a trip profile based upon information received from the second information system 140) and/or information provided by a PTC system (e.g., the first information system 130). For example, if the trip profile requires the vehicle system 400 to traverse a steep incline and the trip profile indicates that the vehicle system 400 is carrying significantly heavy cargo, then the control module 442 may form a trip plan that includes or dictates increased tractive efforts for that segment of the trip to be provided by the propulsion subsystem 460 of the vehicle system 400. In an embodiment, the control module 442 includes a software application or system such as the Trip Optimizer™ system provided by General Electric Company. The control module 442 may directly control the propulsion system 460 and/or may provide prompts to an operator for control of the propulsion system 460. As discussed above, control activities planned by the trip planning control module 440 may be overridden by control activities called for by the automatic control module 430. Further, the trip planning control module 440 may modify the trip plan based on control activities called for by the automatic control module 430 (e.g., a speed on a later portion of the trip may be adjusted to account for an alteration to speed caused by the automatic control module 430).

In an embodiment, a system includes a communication unit and processing unit. The communication unit is configured to obtain first trip information including first location-based operational information. In some embodiments, the first trip information may be obtained from a first off-board source. The first trip information includes commands for a PTC system. The communication unit is also configured to obtain second trip information. In some embodiments, the second trip information may be obtained from a second off-board source that is different from the first off-board source. The second trip information includes second location-based operational information. The second trip information includes trip profile information for performing a mission by the vehicle. The processing unit is configured to determine combined trip information using the first trip information and the second trip information received from the communication unit. The processing unit is also configured to develop control information using the combined trip information.

In another aspect, the first trip information is provided by an operator of the route and the second trip information is provided by an operator of the vehicle.

In another aspect, the processing unit is configured to select a more restrictive setting from the first trip information and the second trip information to determine at least a portion of the combined trip information.

In another aspect, the first trip information and the second trip information include range information corresponding to geographic ranges for use of a first or second mode of operation of the vehicle. For example, the first trip information may include first milepost information defining one or more first zones where manual control of the vehicle is mandated, and the second trip information may include second milepost information defining one or more second zones where manual control of the vehicle is mandated. The combined trip information may include combined milepost information that includes the one or more first zones and the one or more second zones.

In another aspect, the second trip information includes information corresponding to an additional operational feature not included in the first trip information. For example, in some embodiments, the additional operational feature is tractive effort limitation.

In another aspect, the processing unit is configured to provide at least a portion of the control information to a propulsion system of the vehicle.

In an embodiment, a system includes a determination unit and a communication unit. The determination unit is configured to develop first location-based operational information for a vehicle traversing a route. The first location-based operational information developed by the determination unit differs from second location-based operational information provided to the vehicle from a different source. The first location-based information developed by the determination unit includes range information that includes one or more ranges for modes of operation of the vehicle that differs from range information from the different source. The second location-based operational information from the different source includes commands for a PTC system, and the first location-based operational information developed by the determination unit includes trip profile information for performing a mission by the vehicle. The communication unit is configured to transmit the trip information to the vehicle.

In another aspect, the location-based operational information includes trip profile information configured for use by an energy management system of the vehicle.

In another aspect, the location-based operational information specifies a range for which an autonomous mode of operation is permitted, wherein the range differs from a range specified by the different source.

In another aspect, one or more aspects of the first location-based information and one or more aspects of the second location-based information address at least one of a common feature or functionality, and the one or more aspects of the first location-based information and the one or more aspects of the second location-based information are inconsistent with each other. For example, the one or more aspects of the first location-based information are more restrictive than the one or more aspects of the second location-based information.

In another aspect, the location-based operational information includes information corresponding to an additional operational feature not included in information provided by the different source. For example, the additional operational feature may include a tractive effort limitation.

An embodiment relates to a method that includes obtaining, on-board a vehicle traversing a route, first trip information. In some embodiments, the first trip information may be obtained from a first source (e.g., an owner, operator, or administrator of the route). The first trip information includes first location-based operational information. The first trip information includes commands for a PTC system. The method also includes obtaining, on-board the vehicle, second trip information. The second trip information may, for example, be obtained from a second source (e.g., an owner, operator, or administrator of the vehicle). The second trip information includes second location-based operational information. The second trip information includes trip profile information for performing a mission by the vehicle. Also, the method includes determining, with a processing unit disposed on-board the vehicle, combined trip information using the first trip information and the second trip information. Further, the method includes developing control information using the combined trip information.

In an embodiment of the method, the first trip information and the second trip information include range information corresponding to geographic ranges for use of a first or second mode of operation of the vehicle. For example, the first trip information may include first milepost information defining one or more first zones where manual control of the vehicle is mandated, the second trip information may include second milepost information defining one or more second zones where manual control of the vehicle is mandated, and the combined trip information may include combined milepost information that includes the one or more first zones and the one or more second zones.

In an embodiment of the method, the second trip information includes information corresponding to an additional operational feature not included in the first trip information. For example, in some embodiments, the additional operational feature is tractive effort limitation.

In an embodiment of the method, the first source is at least one of an owner, operator or administrator of the route, and the second source is at least one of an owner, operator, or administrator of the vehicle.

In an embodiment of the method, the determining the combined trip information includes selecting a more restrictive setting from the first trip information and the second trip information to determine at least a portion of the combined trip information.

Thus, various embodiments provide improved control over areas not addressed by a first information system (e.g., a system providing information from a PTC database). Also, various embodiments provide remote implementation of additional functionality not addressed by a first information system (e.g., a system providing information from a PTC database). Further, various embodiments provide additional safety control based on specific considerations of a vehicle or preferences of an owner, operator, or administrator of the vehicle.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the inventive subject matter without departing from its scope. While the dimensions and types of materials described herein are intended to define the parameters of the inventive subject matter, they are by no means limiting and are exemplary embodiments. Many other embodiments will be apparent to one of ordinary skill in the art upon reviewing the above description. The scope of the inventive subject matter should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose several embodiments of the inventive subject matter, and also to enable one of ordinary skill in the art to practice the embodiments of inventive subject matter, including making and using any devices or systems and performing any incorporated methods. The patentable scope of the inventive subject matter is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

The foregoing description of certain embodiments of the present inventive subject matter will be better understood when read in conjunction with the appended drawings. To the extent that the figures illustrate diagrams of the functional blocks of various embodiments, the functional blocks are not necessarily indicative of the division between hardware circuitry. Thus, for example, one or more of the functional blocks (for example, controllers or memories) may be implemented in a single piece of hardware (for example, a general purpose signal processor, microcontroller, random access memory, hard disk, and the like). Similarly, the programs may be stand-alone programs, may be incorporated as subroutines in an operating system, may be functions in an installed software package, and the like. The various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "an embodiment" of the presently described inventive subject matter are not intended to be interpreted as excluding the existence of additional embodiments that also incorporate the recited features. Moreover, unless explicitly stated to the contrary, embodiments "comprising," "comprises," "including," "includes," "having," or "has" an element or a plurality of elements having a particular property may include additional such elements not having that property.

What is claimed is:

1. A system comprising:

a communication unit configured to be disposed onboard a vehicle configured to traverse a predetermined route, wherein the communication unit is further configured to:

obtain first trip information from off-board the vehicle, the first trip information including first location-based operational information, wherein the first trip information includes commands including first restrictions standardized for vehicles traversing the predetermined route without individual consideration of capabilities or configurations of any particular vehicle; and obtain second trip information from off-board the vehicle, the second trip information including second location-based operational information, wherein the second trip information includes trip profile information for performing a mission by the vehicle along the predetermined route, the second trip information including second restrictions based on at least one of capabilities or configuration of the vehicle, wherein the first trip information and the second trip information address at least one of a common feature or functionality;

a processing unit configured for operative coupling with the communication unit and to:

determine a combined trip plan using the first trip information and the second trip information received from the communication unit, the combined trip plan setting forth tractive commands for performance of a trip along the predetermined route by the vehicle; and develop control information using the combined trip plan during a trip initialization performed before the trip commences; and a control unit configured to be disposed onboard the vehicle and coupled with the processing unit, the control unit configured to control the vehicle along the predetermined route using the control information developed by the processing unit.

2. The system of claim 1, wherein the first trip information is provided by at least one of an operator, owner, or administrator of the route located off-board the vehicle, and the second trip information is provided by at least one of an operator, owner, or administrator of the vehicle located off-board of the vehicle.

3. The system of claim 1, wherein the first trip information and the second trip information have inconsistencies, wherein the processing unit is configured to address the inconsistencies by selecting a setting from one of the first trip information or the second trip information that is more restrictive than a corresponding setting of the other of the first trip information or the second trip information to determine at least a portion of the combined trip plan.

4. The system of claim 1, wherein the first trip information and the second trip information include range information corresponding to geographic ranges for use of a first or second mode of operation of the vehicle.

5. The system of claim 1, wherein the first trip information includes first milepost information defining one or more first zones where only manual control of the vehicle is permitted, wherein the second trip information includes second milepost information defining one or more second zones where only manual control of the vehicle is permitted, and wherein the combined trip plan includes combined milepost information that includes the one or more first zones and the one or more second zones.

6. The system of claim 1, wherein the second trip information includes information corresponding to an additional operational feature not included in the first trip information.

7. The system of claim 6, wherein the additional operational feature comprises a tractive effort limitation.

8. The system of claim 1, wherein the control unit is configured to utilize at least a portion of the control information to control a propulsion system of the vehicle for controlling movement of the vehicle along the route.

9. The system of claim 1, wherein the first trip information is in a standardized format, and the second trip information is in a second format proprietary to an owner or administrator of the vehicle, wherein the processing unit is configured to modify the first and second trip information to be in a common format.

10. The system of claim 1, wherein the first trip information and the second trip information comprise corresponding speed limits.

11. The system of claim 1, wherein the first trip information and the second trip information comprise corresponding ranges for which autonomous control is not permitted.

12. A system comprising:

a determination unit configured to develop first location-based operational information for a vehicle traversing a predetermined route, the determination unit disposed off-board the vehicle, the first location-based operational information provided to the vehicle from a first source differing from second location-based operational information provided to the vehicle from a different source, the first location-based operational information comprising first range information corresponding to one or more ranges for modes of operation of the vehicle differing from second range information from the different source, wherein the second location-based operational information from the different source includes commands for a positive train control (PTC) system, and wherein the first location-based operational information developed by the determination unit includes trip profile information for performing a mission by the vehicle along the predetermined route, the first location-based operational information including first restrictions based on at least one of capabilities or configuration of the vehicle, the second location-based operational information including second restrictions standardized for vehicle traversing the route without individual consideration of capabilities or configurations of any particular vehicle, wherein the first location-based operational information and the second location-based operation information address at least one of a common feature or functionality;

a communication unit configured to transmit the trip profile information to the vehicle;

a processing unit configured to determine a combined trip plan using the first location-based operational information and the second location-based operational information, the combined trip plan setting forth tractive commands for performance of a trip by the vehicle along the predetermined route, the processing unit configured to develop control information using the combined trip plan; and a control unit configured to be disposed onboard the vehicle and coupled with the processing unit, the control unit configured to control the vehicle using the control information.

13. The system of claim 12, wherein the first range information specifies a range for which an autonomous mode of operation is permitted, wherein the range for which an autonomous mode of operation is permitted differs from a range for which an autonomous mode of operation is permitted as specified by the different source.

14. The system of claim 12, wherein one or more aspects of the first location-based operational information and one or more aspects of the second location-based operational information are inconsistent with each other.

15. The system of claim 14, wherein the one or more aspects of the first location-based operational information are more restrictive than the one or more aspects of the second location-based operational information.

16. The system of claim 14, wherein the first location-based operational information includes information corresponding to an additional operational feature not included in information provided by the different source.

17. A method including:

obtaining, on-board a vehicle traversing a predetermined route, first trip information from off-board the vehicle, the first trip information including first location-based operational information, wherein the first trip information includes commands including first restrictions standardized for vehicles traversing the predetermined route without individual consideration of capabilities or configurations of any particular vehicle;

obtaining, on-board the vehicle, second trip information from off-board the vehicle, the second trip information including second location-based operational information, wherein the second trip information includes trip profile information for performing a mission by the vehicle along the predetermined route, the second trip information including second restrictions based on at least one of capabilities or configuration of the vehicle, wherein the first trip information and the second trip information address at least one of a common feature or functionality;

determining, with a processing unit disposed on-board the vehicle, a combined trip plan using the first trip information and the second trip information, the combined trip plan setting forth tractive commands for performance of a trip by the vehicle along the predetermined route;

developing, during a trip initialization performed before commencing the trip, control information using the combined trip information; and controlling the vehicle along the predetermined route using the control information developed using the combined trip plan.

18. The method of claim 17, wherein the first trip information and the second trip information include range information corresponding to geographic ranges for use of a first or second mode of operation of the vehicle.

19. The method of claim 17, wherein the first trip information includes first milepost information defining one or more first zones where manual control of the vehicle is mandated, wherein the second trip information includes second milepost information defining one or more second zones where manual control of the vehicle is mandated, and wherein the combined trip information includes combined milepost information that includes the one or more first zones and the one or more second zones.

20. The method of claim 17, wherein the second trip information includes information corresponding to an additional operational feature not included in the first trip information.

21. The method of claim 20, wherein the additional operational feature comprises a tractive effort limitation.

22. The method of claim 17, wherein the first trip information is obtained from a first source comprising at least one of an owner, operator, or administrator of the route located off-board the vehicle, and wherein the second trip information is obtained from a second source comprising at least one of an owner, operator, or administrator of the vehicle located off-board the vehicle.

23. The method of claim 17, wherein the determining the combined trip information comprises selecting a setting from one of the first trip information or the second trip information that is more restrictive than a corresponding setting from the other of the first trip information or the second trip information to determine at least a portion of the combined trip information.

24. A system comprising:

at least one processor configured to be disposed onboard a vehicle configured to traverse a predetermined route, wherein the at least one processor is further configured to:

obtain first trip information, the first trip information including first location-based operational information, wherein the first trip information includes commands for a positive train control system including first restrictions standardized for vehicles traversing the predetermined route without individual consideration of capabilities or configurations of any particular vehicle;

obtain second trip information, the second trip information including second location-based operational information, wherein the second trip information includes trip profile information for performing a mission by the vehicle along the predetermined route, the second trip information including second restrictions based on at least one of capabilities or configuration of the vehicle, wherein the first trip information and the second trip information address at least one of a common feature or functionality;

determine combined trip information using the first trip information and the second trip information;

develop control information using the combined trip information; and control the vehicle along the predetermined route using the control information that is developed.

* * * * *